US010119771B2

(12) United States Patent
Kelly

(10) Patent No.: US 10,119,771 B2
(45) Date of Patent: Nov. 6, 2018

(54) NON-ISOTROPIC STRUCTURES FOR HEAT EXCHANGERS AND REACTORS

(75) Inventor: John T. Kelly, Saratoga, CA (US)

(73) Assignee: Altex Technologies Corporation, Sunnyvale, CA (US)

( * ) Notice: Subject to any disclaimer, the term of this patent is extended or adjusted under 35 U.S.C. 154(b) by 992 days.

(21) Appl. No.: 13/343,620

(22) Filed: Jan. 4, 2012

(65) Prior Publication Data

US 2012/0261106 A1 Oct. 18, 2012

Related U.S. Application Data

(60) Provisional application No. 61/475,116, filed on Apr. 13, 2011.

(51) Int. Cl.
*F28F 3/02* (2006.01)
*F28F 3/08* (2006.01)
*F28F 3/12* (2006.01)

(52) U.S. Cl.
CPC ..... *F28F 3/022* (2013.01); *Y10T 29/4935* (2015.01)

(58) Field of Classification Search
CPC .... F28F 3/02; F28F 3/022; F28F 3/025; F28F 3/08; F28F 3/12; H01L 23/3677; H05K 7/20154; Y10T 29/4935
USPC ..... 165/80.3, 146
See application file for complete search history.

(56) References Cited

U.S. PATENT DOCUMENTS 2,870,998 A 1/1959 Woolard
3,296,686 A * 1/1967 Stauffer ..... B21D 53/04 165/183
3,313,343 A * 4/1967 Ware et al. ..... 165/166
5,107,575 A * 4/1992 Ishida et al. ..... 29/890.048
5,311,928 A * 5/1994 Marton ..... F28F 1/12 165/185
5,794,684 A * 8/1998 Jacoby ..... F28F 3/02 165/185

FOREIGN PATENT DOCUMENTS

| | | |
|---|---|---|
| DE | 23 33 697 | 1/1975 |
| EP | 1 703 556 | 9/2006 |
| FR | 1 135 963 | 5/1957 |
| FR | 1135963 A1 * | 5/1957 |
| FR | 2 295 769 | 7/1976 |
| GB | 1 450 460 | 9/1976 |
| JP | 08178571 A * | 7/1996 |

(Continued)

OTHER PUBLICATIONS

Cengal, "Introduction to Thermodynamics and Heat Transfer", Sep. 2007, second edition, pp. 429-447.*

(Continued)

*Primary Examiner* — Grant Moubry
*Assistant Examiner* — Harry Arant
(74) *Attorney, Agent, or Firm* — Squire Patton Boggs (US) LLP

(57) ABSTRACT

A Non-Isotropic Structure for a Heat Exchanger (NISHEX) that forms fins from nested woven wire meshes. The wire meshes are shaped into channels that are stacked on top of each other to produce a non-isotropic fin structure having multiple fin layers. The fin structure exhibits a high heat coefficient while maintaining relatively high fin efficiency through the selection of fin lengths in proportion to the wire diameter in the mesh fins.

2 Claims, 8 Drawing Sheets

(56) References Cited

FOREIGN PATENT DOCUMENTS

| | | | | |
|---|---|---|---|---|
| JP | 3157834 U | * | 3/2010 | |
| WO | WO 02/063231 | | 8/2002 | |
| WO | WO02063231 A1 | * | 8/2002 | |
| WO | WO 2011094282 A1 | * | 8/2011 | ..... C07C 209/02 |

OTHER PUBLICATIONS

International Search Report for PCT/US2012026181, dated May 29, 2012, 5 pgs.

* cited by examiner

NON-ISOTROPIC STRUCTURES FOR HEAT EXCHANGERS AND REACTORS

PRIORITY CLAIM

This application claims priority U.S. provisional application No. 61/475,116 filed on Apr. 13, 2011.

This invention was made with Government support, under Contracts N00014-10-C-0325 and N68936-11-C-0004, awarded by the US Navy. The Government has certain rights in the invention.

FIELD OF THE INVENTION

The present invention relates to heat exchangers and reactors.

BACKGROUND OF THE INVENTION

Finned Compact Heat Exchangers.

Heat Exchanger (HEX) size and weight with gas flows are typically limited by the low conductivity of the gas and resulting lower gas side heat transfer coefficients. In these cases, the surface area of plates that separate the fluids, or bound the source of heat (e.g. electronics component) or cooling, is insufficient to meet performance requirements. Fins are added to the separating plate, or primary surface area, to add surface area and reach out into the gas flow. This facilitates the flow of heat from the gas to the separating plate. Fins can increase surface area exposed to the gas by multiple factors. In fact, in some examples, fins represent over 80% of the available surface area. While the fins provide enhanced surface area and heat transfer, the added area also adds weight, volume, pressure drop and cost. Therefore, fin configurations need to be carefully chosen to optimize heat transfer while minimizing volume, weight, pressure drop and cost.

Thermal Efficiency (TE), which is the ratio of the heat transfer coefficient to the friction, or pressure drop, factor, is an important measure of heat exchanger performance, since there is always a tradeoff between heat transfer effectiveness and pumping power losses. Pumping power losses are a serious limitation in many cases. Therefore, a fin configuration that minimizes pressure drop, or pumping power, for a given heat transfer is highly desired. In these cases, the HEX can be made more compact (lower volume and higher face velocity cases), without causing excessive pumping power. Table 1 lists the thermal efficiencies of several conventional fins, including plain plate, perforated plate, wavy plate, and louvered fins. The thermal efficiency (TE) in the table is defined as the heat transfer Stanton (St) number times Prandtl (Pr) number, to the two-thirds power, over the friction (f) coefficient. The non-dimensional St and Pr combination is a measure of the heat transfer for the fin configuration of interest, with the non-dimensional f playing a similar role for pressure drop. Plain plate fins are very simple, and relatively easy to form. The perforated fin requires that small holes be formed in the plain plate fin, which makes this fin more expensive. The wavy fin configuration doesn't require holes, but special tooling is required to form the wavy surfaces that need to be fitted between separation plates, or on tubes. Lastly, louvered fins are the most complex to form and probably the most expensive.

Plain fins simply increase the amount of surface area exposed to the gas, and through heat conduction to the fluid in adjoining tubes or channels, increase the heat transfer.

Well-known formulas can be used to define the effectiveness of the increased fin surface area, or fin efficiency. With the plain fin, a boundary layer develops on the plate that has a high heat transfer coefficient at the front of the plate where the boundary layer starts and is very thin. However, the coefficient drops substantially with distance, as the boundary layer thickens. On average, the heat transfer coefficient is then relatively low over the whole plate. With perforated fins, the smooth boundary layer of the plain fin becomes interrupted at the perforations. As the boundary layer restarts at each perforation, the heat transfer coefficient again reaches a locally high level. With the constant restarting of the boundary layer, the average heat transfer coefficient is increased over that for the plain fin. This is very beneficial. However, because of the restarting of the boundary layer, friction, or pressure drop, also increases. However, the net overall effect is beneficial, as noted by the TE value in Table 1. As shown, the perforated plate fin has the best Thermal Efficiency (TE) of all of the cases. Therefore, for a given pressure drop, perforated plates would produce the highest heat transfer.

TABLE 1

Comparison of Fin Thermal Efficiencies at Reynolds Number of 1000

| Fin Type | Thermal Efficiency ($StPr^{2/3}/f$) |
|---|---|
| Plain Plate | 0.283 |
| Perforated Plate | 0.338 |
| Wavy Plate | 0.182 |
| Louvered Plate | 0.236 |

Wavy wall and louvered fin thermal efficiencies are not as high as that for the perforated fin, as indicated in Table 1. It is speculated that the disruption of the boundary layer in the perforated fin case is modest, and the overall pressure drop, consisting of both form (i.e. fluid separation zones) and surface friction contributions, is not significantly increased versus the plain plate fin case. The net result is a higher heat transfer than a plain fin and only modestly higher pressure drop, giving enhanced thermal efficiency. In contrast, the louvered fins have substantial protrusions into the flow. These create substantial flow disruptions and flow separation. Heat transfer is increased as a result of these disruptions. However, pressure drop is also substantially increased, resulting in a net reduction of thermal efficiency. For the wavy wall case, flow separations can also be induced as the flow moves over the "waves", resulting in improved heat transfer, but also a reduction in thermal efficiency relative to the perforated plate case. In conclusion, the perforated plate yields the best thermal efficiency, as a result of boundary layer disruption, but not bulk flow disruption. This high thermal efficiency is important to controlling pressure drop in compact HEXs.

As noted above, for optimal thermal efficiency, the boundary layer along the fin should be disrupted, but large scale flow disruptions should be avoided. The greater the frequency of boundary layer disruption, the higher the average heat transfer coefficient, for a nearly fixed thermal efficiency. Therefore, a plate with many perforations might be best. However, it is difficult to form many perforations, and fin cost could substantially increase.

Foam-Based Heat Exchangers.

As noted above, compact finned heat exchangers are well developed and proven, but they do not offer heat transfer and pressure drop performance that can meet advanced cooling or heating requirements. To achieve goals for these applications, substantial advances are required in heat exchanger materials and configurations. As a significant departure from compact finned heat exchangers, open cell metal and graphite foams have been put forward as advanced thermal management solutions for challenging applications, such as fusion reactors. An open cell foam structure viewed in close-up shows small structures in the open cell foam that adds substantial surface area for heat transfer. While offering orders of magnitude increases in surface area and heat transfer capability, these materials have correspondingly much higher pressure drop than is desired for many applications. Also, these materials have very thin ligaments that connect with the adjoining tubes or channels that contain the heat transfer fluids. This limits the effectiveness of the high surface area by bottle-necking the flow of heat to the fluid. The result is a lower thermal efficiency compared to the fin configurations listed in Table 1. In addition, these materials are very expensive.

What is needed is a new material that has the heat transfer performance of open-celled foams, with a pressure drop that is much lower per heat transferred, as well as a lower volume, weight, and a much lower cost.

SUMMARY OF THE INVENTION

As indicated above, high performance compact heat exchangers and reactors need substantial surface area in contact with the fluid. This is typically provided by fins that extend out into the flow and provide extra area that augments heat flow to or from the separating plate, or boundary, that is the heat sink or heat source, respectively. While heat flow is augmented, the design of the fins can constrain the flow of heat as a result of conduction limits through the fins. This is quantified by fin effectiveness, which is equal to the ratio of the heat flow per area through the fin surface divided by that achieved at the fin and separating plate contact area. Unless the fin effectiveness can be maintained at high levels, fin area will be excessive, resulting in excessive weight, pressure drop and cost to achieve a given heat transfer.

An innovative and low-cost approach to fin manufacture has been discovered, called Non-Isotropic (or anisotropic) Structure for a Heat Exchanger (NISHEX), that uses a non-isotropic fin structure to simultaneously maximize heat transfer and weight, while minimizing pressure drop and cost. In this approach, small scale fin structures that have high heat transfer are implemented near the surface, where distance from the surface is limited and fin effectiveness is high. With distance away from the surface, larger structures are utilized to maintain high effectiveness throughout the structure. By ordering the structure in this way, optimal use of materials and maximum heat transfer are achieved for the minimum pressure drop and cost. Because the needed non-isotropic features can be achieved by a variety of construction methods and materials, the process is very flexible and addresses many applications. Heat sink, radiator, condenser, evaporator and many other applications can be considered. Also, by inclusion of wash coat and catalysts, simultaneous heat transfer and reaction can be considered.

A NISHEX is a fin having a non-isotropic structure to optimize heat transport properties. The fins of a NISHEX are formed by a first structure and a second structure interconnected to, and arranged parallel to the first structure. A NISHEX structure is characterized, at least in part, by frequent boundary layer restarts and low pressure differences across a fin surface, and avoidance of heat conduction bottlenecks near a heat sink, heat source or separation plate surface, while at the same time maintaining an optimal fin effectiveness due to the novel non-isotropic properties of fin structures constructed in accordance to the invention.

In preferred embodiments, first and second elongate fin structures are provided by commercially available woven wire meshes, examples of which are illustrated in FIG. 3 (perforated or slotted sheets may also be used in place of wires). In some embodiments a plurality of wire meshes are combined to form a "non-isotropic" fin, which refers to a fin constructed of several layered or stacked wire meshes where the mesh wires between one layer and another have different diameters and are disposed at different lengths from a plate surface (in some cases in proportion to the wire diameter) when a NISHEX construct is assembled. The individual wires in woven wire meshes are used to constantly restart the boundary layer and achieve high heat transfer for the HEX. This structure minimizes pressure drop, volume, weight and cost.

INCORPORATION BY REFERENCE

All publications and patent applications mentioned in this specification are herein incorporated by reference to the same extent as if each individual publication or patent application was specifically and individually indicated to be incorporated by reference. To the extent there are any inconsistent usages of words and/or phrases between an incorporated publication or patent and the present specification, these words and/or phrases will have a meaning that is consistent with the manner in which they are used in the present specification.

BRIEF DESCRIPTION OF THE DRAWINGS

Non-limiting and non-exhaustive embodiments of the invention are described with reference to the following figures, wherein like reference numerals refer to like parts throughout the various views unless otherwise specified.

DETAILED DESCRIPTION OF EMBODIMENTS

Theory

Figure 1:
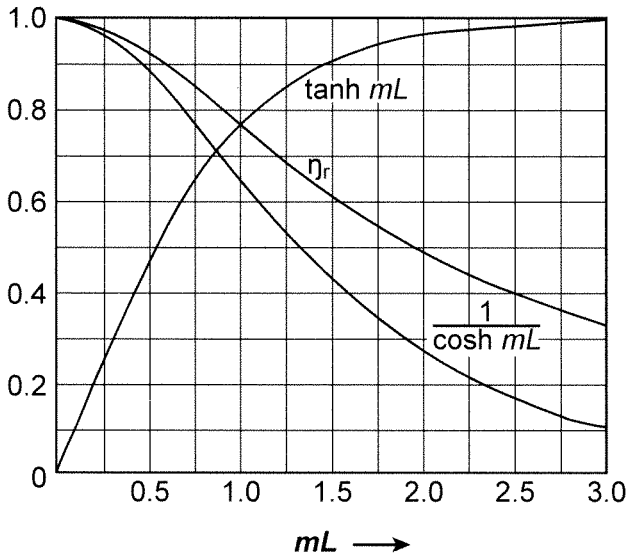
FIG. 1 shows the changes in fin effectiveness verses fin length, L.

Through recent investigations of foams and other enhanced heat transfer methods, it has been concluded that a primary limitation of foam is a result of its isotropic nature. Heat transfer from a sink to air has to occur via heat flow from the source through structures that reach out into the air-flow. These structures can be a bottleneck to heat transfer, which is commonly termed "low fin effectiveness". FIG. 1 presents fin effectiveness results, Nr, as a function of mL, where L is the length of the fin and m is a key parameter defined for a pin fin as $m=(4\ h/kd)^{1/2}$, where h is the gas heat transfer coefficient, k is the thermal conductivity of the fin material and d is the diameter of the pin.

As shown in FIG. 1, as the fin length L increases, the effectiveness decreases. This is a measure of the effectiveness of the fin surface area versus the area through which the heat passes to the separation plate and adjoining heat transfer fluid, or primary surface area. Overall, heat transfer is equal to the heat transfer coefficient on the surface times the surface area of both the fins and primary surface, the temperature difference between the gas and fin, and lastly, the fin effectiveness. From FIG. 1, it can be seen that as mL increases, the effectiveness is substantially reduced, and thereby heat transfer per fin area and weight is decreased. Therefore, as mL is increased, the fin volume and weight per heat transferred is increased. Also, since the extra surface adds friction and pressure drop, but reduced amounts of heat transfer per area, then pressure drop per heat transfer is increasing. This then negatively impacts the thermal efficiency (TE), as well as increases weight and material cost per unit heat transfer. A new approach is required to simultaneously optimize weight, pressure drop, and heat transfer.

Figure 2:
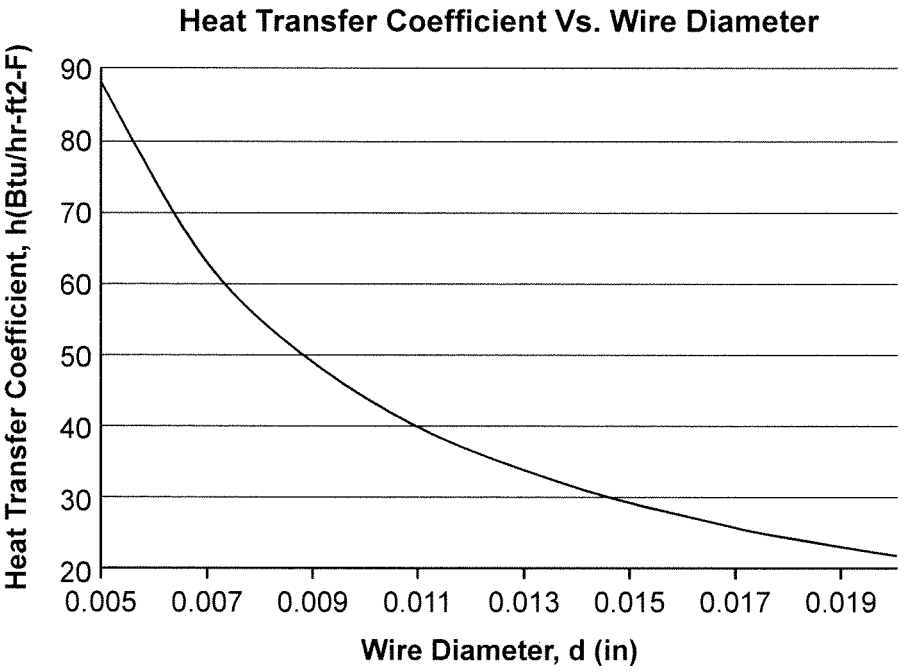
FIG. 2 shows a change in heat transfer coefficient verses wire diameter for a fin.

For optimal air heat transfer, small structures are beneficial to take advantage of the greater surface area per volume and the inverse relationship of the heat transfer coefficient to small scales. FIG. 2 shows that the average heat transfer coefficient increases as the diameter of a "pin" fin decreases. In fact, the increase varies inversely with the fin diameter; however, the smaller the diameter of the structure, the greater the heat flow bottleneck from the heat source. Examining the mL parameter, for a pin fin, h increases inversely with the diameter, for small structures, or $h=(k_g N_u)/d$, where kg is the air or fluid conductivity and Nu is the non-dimensional Nusselt number for heat transfer. Inserting this into the expression for m, as defined above, the product mL then becomes $(2\ L/d)(Nuk_g/k)^{1/2}$, where Nu is a constant for small wires and laminar flow. Therefore, as the HEX fin structures become smaller, the length, L, has to decrease in order for fin effectiveness to remain constant, as per FIG. 1.

For an isotropic structure attached to adjoining tubes or channels containing heat transfer fluids, there is then a basic conflict between optimal heat removal to the air and the bottlenecking of heat flow through the structure. Shrinking the height of the heat exchanger fin structure (e.g. isotropic foam), and thereby forcing the air to flow close to the surface of the heat source, can better balance this conflict. However, gas flow velocity through the structure and thereby pressure drop, which is a power function of velocity, increases beyond acceptable levels. In contrast, using a much taller isotropic structure, to stay within the gas flow pressure drop requirement then results in the addition of significant material that has diminished heat transfer contribution, but a significant contribution to pressure drop and weight. Given these limitations, an approach was found to make a non-isotropic material structure at low cost that is a significant advance beyond isotropic structures, such as foams. This approach can be used with plate type fins, described in FIG. 2, but also benefits from wire mesh-based fins that have small structures. In addition, the approach can utilize other means of construction, including foam, as long as the non-isotropic material nature is incorporated, as described below.

Non-Isotropic Wire Mesh for Fins

Figure 3:
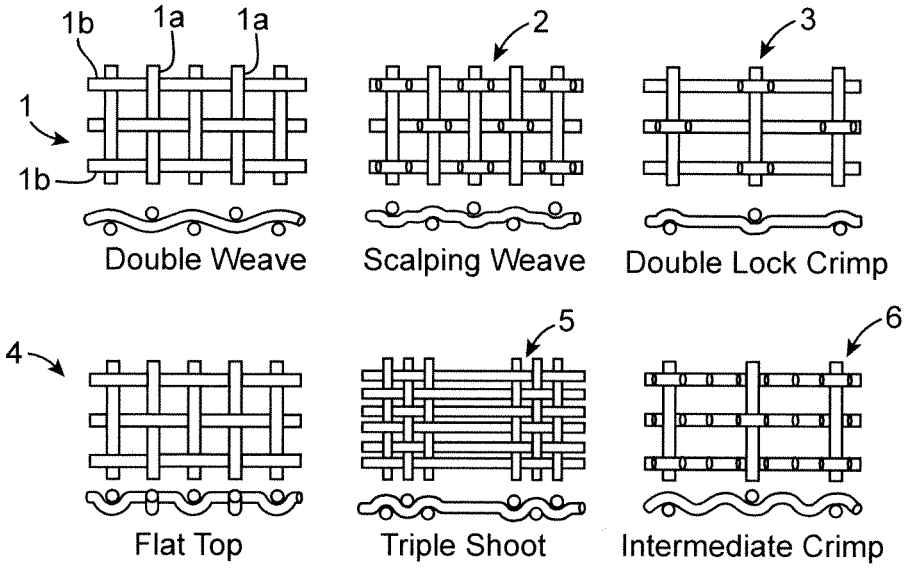
FIG. 3 illustrates examples of wire meshes that may be used to construct a NISHEX.

To achieve the same effect as a highly perforated plate fin at low cost, fins may be formed using a woven wire material. Examples of this type of material are illustrated in FIG. 3, which shows various types of mesh constructed of inexpensive wire that is readily available. Six types of wire mesh weaves are shown in FIG. 3. They are the double weave 1, scalping weave 2, double lock crimp 3, flat top 4, triple shoot, 5 and intermediate crimp 6. These weave types are well-known in the art. See e.g., U.S. 2002/0134709. As will be understood more fully from the description of embodiments of a NISHEX that follows, one or more of the wire meshes 1-6 may be arranged in the following manner when formed into a NISHEX. Using as an example the double weave 1, one of the wires, e.g., wires 1*a*, are aligned substantially parallel to the mean flow direction through the HEX (or along the surface of a separation, heat source/sink plate), while the other of the wires, e.g., wires 1*b*, are arranged about perpendicular to the mean flow direction through the HEX. One of the wires, e.g., wires 1*b*, are then shaped, formed or corrugated into a desired channel shape while the other of the wires serve to tie or hold the shaped wires together so that they may be readily shaped into the fins and secured to the plate.

In addition, the diameter of the wire for the weaves illustrated in FIG. 3 can be different, e.g., wires 1*a*, can have a larger diameter than wires 1*b*. Therefore, the wires extending in one direction can be constructed to have a higher heat transport capability than the wire extending in the other direction. This non-isotropic or anisotropic property could be beneficially used to augment heat transfer perpendicular to, versus that parallel to the mean flow direction through the HEX. This characteristic is advantageous, versus the perforated or plain fin, where heat conduction parallel to the mean flow direction is as high as that perpendicular to the mean flow direction through the HEX, i.e., an isotropic fin. With the non-isotropic NISHEX, the overall heat exchanger effectiveness or approach to the theoretical maximum heat transfer, is improved for counter-flow of heat transfer fluid configurations.

Figure 4:
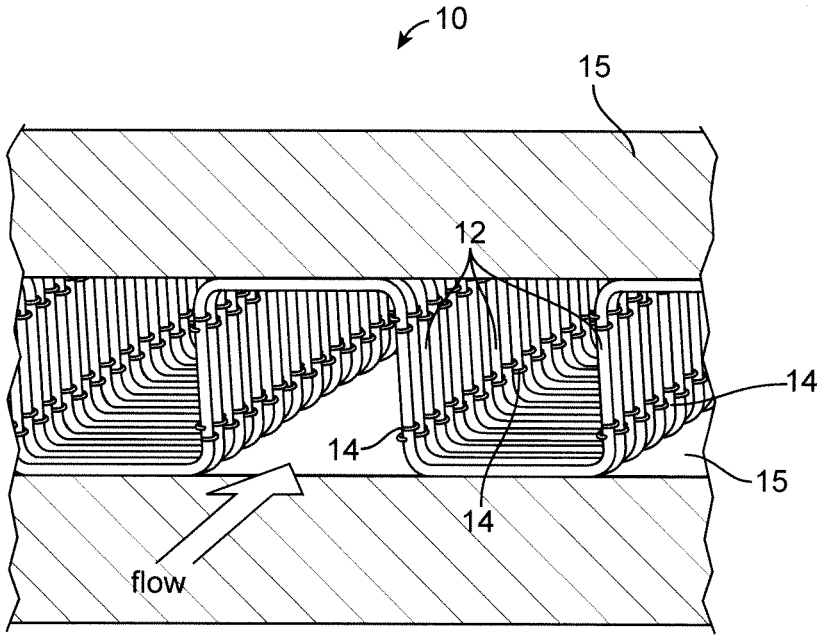
FIG. 4 is a perspective view of a first embodiment of a NISHEX having a single fin.

The wire mesh material can be corrugated into channels that are then bonded to flattened tubes or channel, which contain fluid, or to a boundary plate, to which a heat generating component (e.g. electronic component) is attached. In one embodiment a NISHEX 10 uses a highly anisotropic wire mesh, as illustrated in FIG. 4. The wire mesh is corrugated in the direction perpendicular to the mean flow direction through the HEX and then bonded to flattened tubes or channel or a boundary plate 15. The mean flow direction through the channels is indicated in FIG. 4. The wire mesh has a first wire type 12 having a first diameter connected to adjacent first wire types 12 along the mean flow direction by a second wire type 14 having a second diameter which is much smaller than the first diameter.

Almost the entire mass of the wire mesh used to form NISHEX 10 is in the wires 12 that extend perpendicular to the fluid separation, heat source, source plate or boundary plate 15, with comparatively few number of, and thinner wires 14 parallel to the mean flow direction, and adequate to hold the wires 12 together ahead of bonding to the separation plates. These smaller, parallel wires 14 act like fins-on-fins, and provide structural stability, which has benefit. However, if wires 14 are equal in number to the perpendicular wires 12 and had the same diameter as wires 12, i.e., the weight and pressure drop for a given heat transfer will not be as optimal. Therefore, the anisotropic approach of using fewer connecting wires and/or wires of smaller diameter (compared to the perpendicular wires) has better heat transfer, pressure drop and volume and weight characteristics than a uniform mesh. Also, this structure will be superior to open cell isotropic metal foam based fins. The ligaments, or wires in metal foams, are isotropic in three dimensions; that is, they all have similar heat transport capacity in three directions. Therefore, foams have many "fins-on-fins", relative to the structure shown in FIG. 4. In fact, one half of the fins-on-fins for a foam are oriented crosswise to the flow, and parallel to the separation plates. These ligaments, or wires, then contribute significantly to pressure drop, and only incrementally to heat transfer, driving down thermal efficiency. Therefore, in terms of the efficient use of fin volume and mass to enhance heat transfer, without driving up pressure drop, the concept shown in FIG. 4 is more optimal. An even more optimal approach can be created by using multiple layers of wire mesh that have different lengths, L, in proportion to wire diameter, d, to optimize fin effectiveness, as explained earlier; that is, the greater the lengths of the wire from the surface of a heat sink, heat source or separation plate, the larger the diameter wire mesh used to form a fin.

Figure 5A:
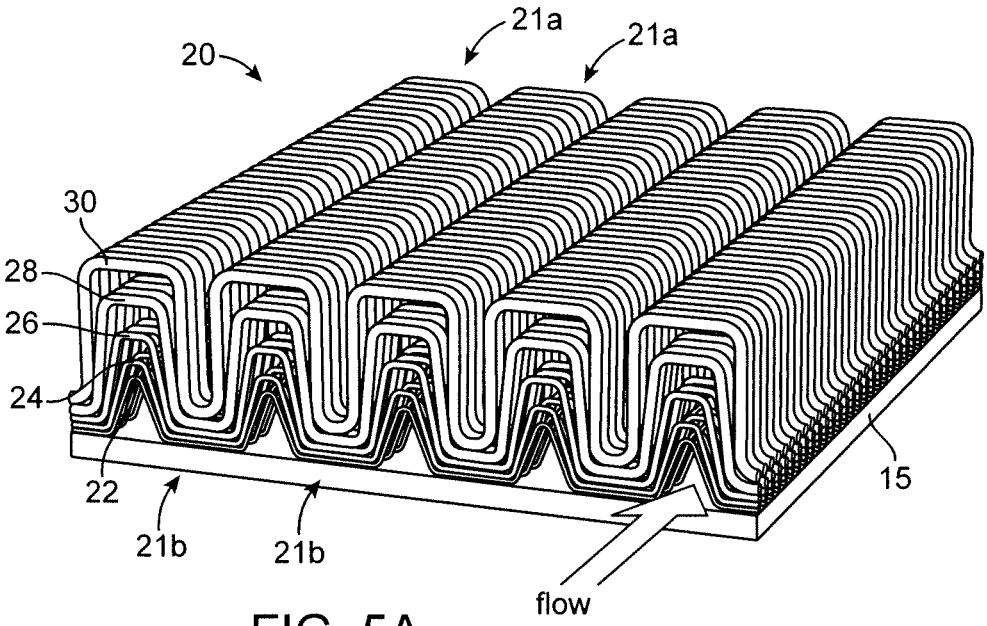
FIGS. 5A and 5B are perspective and side views of a second embodiment of a NISHEX that has multiple layered fins.
Figure 5B:
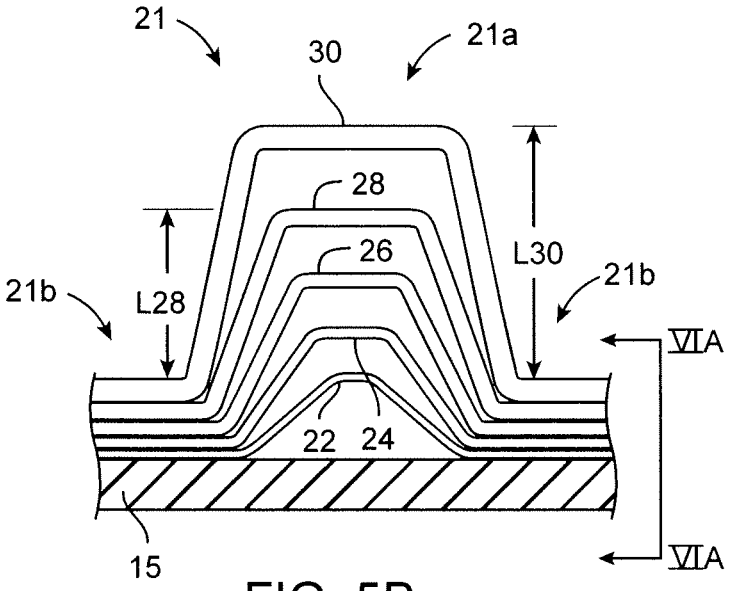

According to the disclosure, a NISHEX utilizes a non-isotropic material configuration that yields a higher level of performance than conventional fins or foams. FIG. 5A shows a partial perspective view of a first embodiment of a NISHEX 20 bonded to a separation, heat sink or source plate 15 (plate 15). There are five layered, or stacked and nested fins forming a fin element 21*a*, versus the single layer fin of NISHEX 10. Two, three, four or any other number of layers could be considered. FIG. 5B shows a front view of a fin element 21*a*. The portion 21*b* of the wire meshes extending between the fin element 21*a* and adjacent fin elements are bonded or connected to the plate 15. The portions 21*b* are in essentially direct contact with the surface of plate 15 after bonding.

The NISHEX 20 has five stacked wire mesh fin layers 22, 24, 26, 28 and 30 with smaller diameter wire fins used closer to the boundary plate 15. Each of the layers 22-30 are corrugated in a direction perpendicular to the flow direction, as in FIG. 4. The smaller diameter wire mesh layers have correspondingly smaller lengths ("length" is measured perpendicular to the surface of the source plate 15). Referring to FIG. 5B, the length L30 for the outer fin layer 30, which uses the largest diameter wire, therefore has a greater length than the length L28 of fin layer 28, which uses a smaller diameter wire. Similarly, the diameter and length of the wire for fin layer 22, is smaller than the diameter and length of the wire in layer 24, which is smaller than the diameter and length of wire in layer 26, and so on. Thus, the wire diameter and length is highest for the outermost fin layer 30. In other words, the arrangement of the fin layers and wire forming the individual layers are such that the diameter of the wire is proportional to its length, i.e., as the diameter wire increases, from the plate 15 surface.

The wire meshes 22, 24, 26, 28, 30 are placed on top of each other and bonded to the source plate 15 at portion 21*b*. The portions 21*b* (FIG. 5B), which are connected to the plate 15, provide effectively a direct heat path to each of the individual wire mesh fins that extend perpendicular to plate 15 and form the fin elements 21*a*, while avoiding bottlenecks at the point of contact with the plate 15, as is common in other fin-on-fin type constructions, e.g., foam ligaments. This is made possible by the amount of surface contact between the portions 21*b* and plate 15 relative to the lengths of the wires forming fin element 21*a*. As shown, the contact area with the plate will be greater than the cross-section of the wire, given the bonding material and particularly if a flat or somewhat flat wire is utilized.

The wires 22, 24, 26, 28 and 30 of the fin element 21*a* conduct the majority of the heat perpendicular to the source plate 15, with a few and/or smaller diameter wires (not shown) of the respective wire meshes holding wires 22, 24, 26, 28 and 30 together, as with the wires 14 of the wire mesh that holds wires 12 together in FIG. 4. It should be noted that FIGS. 5A and 5B are only one possible embodiment, and does not necessarily show an optimal number of layers or wire sizes or cross-section shapes for a particular application.

Accordingly, NISHEX 20 may be constructed of anisotropic wire meshes, e.g., slotted wire meshes, which are folded or corrugated to achieve a multiplicity of parallel channels of predominantly wires perpendicular to the plate 15, as described above, to carry heat into, or remove heat from gas flowing through the channels of the HEX (flow direction being indicated in FIG. 5B). Moreover, as indicated above, meshes made of fine wire are aligned close to the plate 15, while thicker wire meshes extend further out from the plate 15. This structure optimizes the balance between maximizing the heat transfer coefficient on the wires and fin effectiveness. Specifically, small wire structures near the heat source have very high heat transfer coefficients and surface area per mass, both of which scale with the inverse of the wire diameter, as explained above and illustrated in FIG. 2. However, as the diameter is reduced, fin effectiveness is reduced because heat flow along wires becomes the bottleneck. Each additional increment of wire length then becomes less effective, adding wire mass and pressure drop faster than adding heat transfer capability. The wire lengths for each diameter used to form NISHEX 20 are then limited to a length where heat transfer and surface area per mass are maximized, while fin effectiveness is high. As shown above, effectiveness remains constant at a high level, if a fin length, L, is reduced, as wire diameter is reduced. This approach then leads to the ordered structure shown in FIGS. 5A-5B, where thin wire structures, e.g. layers 22, 24, intercept the flow close to the plate, and subsequent layers of thicker wires extend further out into the flow. The result is a non-isotropic structure that minimizes the amount of material for optimal heat transfer as well as minimizes pressure drop and weight. It should also be noted that, unlike foam-based fins or wire screen laminates, where flow direction is through the screens, NISHEX 20 creates a flow parallel to the wire mesh forming the channels to optimize both heat transfer and thermal efficiency. Since flow is along screens, rather than through screens, particulate collection and plugging is avoided. In contrast, small cell foams and isotropic screen laminates with through flow can trap particulate and clog. In the case of a NISHEX, particulate should only build up ahead of the leading edges of the fin elements 21*a*, similar to a conventional fin.

Figure 6A:
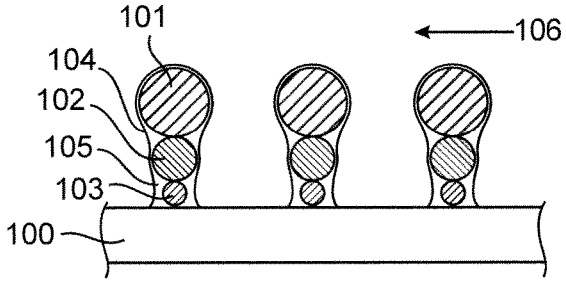
FIGS. 6A through 6D are cross sectional views of stacked, interleaved, interleaved flat wire and interleaved oval wire bond configurations.
Figure 6B:
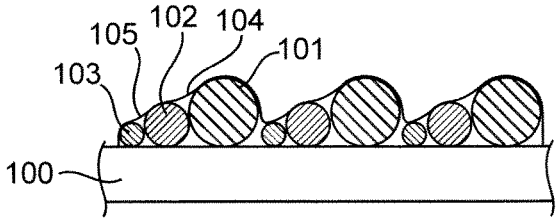
Figure 6C:
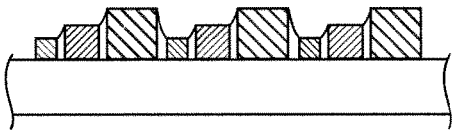
Figure 6D:
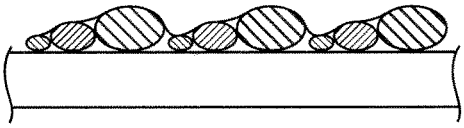

In the above example, the multiple slotted wire mesh layers 22, 24, 26, 28 and 30 (as depicted in FIG. 5B) are placed on top of each other and bonded to the source plate 15 at portion 21*b*. The plate bonding material will provide a heat conduction path through each wire mesh and ultimately to the source plate. With the proper wire and bonding material, the heat conduction will be adequate to minimize thermal resistance. However, the stacking of mesh layers at the bonding line reduces flow area and thereby increases the fin structure volume required for a given flow velocity. To minimize flow blockage and any bond area thermal resistance, the wire can be arranged so that the wires at the bonding surface interleave side by side, rather than stack, as illustrated in FIGS. 6B through 6D, which are cross sections of the interleaved wire arrangements at the bond point with the separation plate 100. The taken in FIGS. 6B through 6D is perpendicular to the flow direction 106 (FIG. 6A is a side view of FIG. 5B with three, as opposed to the five stacked wires depicted in FIG. 5B). FIG. 6B shows the stacked three wire mesh arrangement 101, 102, 103 with a consistent wire spacing and perfect alignment. This is an ideal condition and is not necessary to achieve good performance, and is only used for illustration purposes. As shown, the bonding material will create fillets 104 and 105 that will augment the conduction path from the wires 101, 102, 103 to the separating plate 100. Given the substantial length over which the wires contact the plate, as illustrated in FIGS. 5A and 5B, i.e., portions 21*b*, the thermal resistance at the bond should be low. However, as shown in FIG. 6A, the height of the stacked wires from the plate is higher than the height of the thickest wire 101 and will block some of the flow that is aligned in a cross-direction 106. To reduce flow blockage and bond thermal resistance further, the multiple meshes 101, 102 can be shifted to the right with respect to mesh 103 and interleaved together to create the arrangement versus the separation plate 100, as shown in FIG. 6B. In this case, each wire 101, 102, 103 is in close contact with the separation plate with the bond material fillets, 105 and 104 providing an additional conduction path to the plate 100. The flow blockage for the interleaved case can be less than the stacked case in FIG. 6A. The interleaved alignment can be accomplished with wire mesh (e.g., triple shoot 5 in FIG. 3) where the cross wires 14 in FIG. 4 are aligned along the first wire type 12 in FIG. 4 so that they lie outside the separation plate 100 and bonding zone illustrated in FIG. 6B. To further lower contact resistance and reduce the amount of bonding material and filleting, the rounded wire in FIG. 6B could be replaced by flat or oval wire, as shown in FIGS. 6C and 6D, respectively. These could have various widths versus height ratios to achieve different bond areas versus wire cross-sectional areas.

Compared to Foams and Wall Fins

While boundary layer restarts are optimized with a NISHEX, the configuration also optimizes thermal efficiency, or minimizes pressure drop for a given heat transfer. Louvered and wavy wall fins have been shown to produce high heat transfer. However, because they produce large-scale flow disturbances, including separated flow regions, and block the flow and increase local velocity, they promote pressure drop more aggressively than heat transfer. Therefore, thermal efficiency is low. In contrast, NISHEX channels are parallel to the flow and avoid large-scale flow disturbances and flow blockage. Also, because the wire mesh used for fin layers has many open spaces between wires, the fin layers cannot support pressure differences across the plane of the material. Therefore, large-scale separation regions that create high pressure drop cannot be formed with NISHEX 20. In contrast, solid plate type conventional fins can act like aircraft wings under stall conditions, when the entering heat exchanger flow is at an angle of attack, and large separation regions, flow blockage, high velocity local flows and associated pressure drops, can be created. Since all practical flow situations have some non-parallel flow, pressure drops will be higher with solid plate fins. Pressure drops are reduced using the NISHEX 20 structure of FIGS. 5A-5B or FIG. 4, so that thermal efficiency is improved.

Conventional open cell foams have high heat transfer by having a large number of cell ligaments in contact with the gas flow. However, they also have high-pressure drop and low thermal efficiency. In one respect, foams may be considered as isotropic structure with ligaments equally distributed in three dimensions, since the material configuration is similar in any direction. Only a limited number of ligaments are in contact with the heat sink. Those attached to the plate will readily channel heat to the cooling air. Ligaments branching from these can be considered "fins-on-fins". While providing some benefit, "fins-on-fins" effectiveness is constrained because of the bottleneck of heat transfer at the plate attachment point. Unfortunately, besides adding more weight per heat transfer, these "fins-on-fins" contribute equally to pressure drop relative to ligaments attached to the plate. Therefore, conventional isotropic foams will have high-pressure drop per heat transfer, or a low thermal efficiency.

A NISHEX having one or more mesh wire layers forming fin elements optimizes material use to maximize heat transfer while minimizing pressure drop, by having each of the fin element 21*a* in direct contact with the boundary plate 15. Furthermore, since it represents the optimal use of material per heat transfer, it reduces material weight and thereby cost. For example, NISHEX 20 may be constructed of an anisotropic woven-wire mesh that is folded into needed shapes by conventional and cheap fin-forming equipment. Therefore, forming costs are low. Relative to bonding, well proven similar alloy fin brazing techniques can be utilized to bond all mesh layers to the plate 15. In some applications, a non-metal bonding agent with good conductivity could be utilized. Bonding of wire mesh can be no more costly than typical conventional fin bonding costs. Moreover, given the broad use of woven metal wire mesh in many filtration and separation-type applications, mesh fabrication costs are low. For example, high manufacturing volume meshes are cheaper than solid plates of the same thickness. For example, a typical stainless steel wire mesh would be $\$0.76/ft^2$ versus $\$0.85/ft^2$ for a thin plate of the same thickness. Since the mesh will have approximately 50% more actual surface area than the plate, and a much higher heat transfer coefficient, heat transfer performance is superior to a plate fin. Moreover, material weight of the mesh is substantially less than a plate with the same thickness. The heat transfer per weight of a mesh fin is therefore many times higher than that of a plate fin. Given that much less material is required to achieve a given heat transfer, a NISHEX is considerably lower in cost than conventional fins that provide the equivalent heat transfer. Also, compared to foam approaches, costs are orders of magnitude lower.

The foregoing description often referred to a wire material, or wire mesh to form the fin elements. However, the disclosure contemplates, in the alternative, using layers of perforated or slotted sheet material. It will be appreciated that with the appropriate perforations/slots formed in this sheet material similar results can be achieved as in the case of a wire mesh. Furthermore, through the use of non-isotropic molds and casting of metal a structure and results similar to the wire mesh case can be achieved. Lastly, while reference has been made to metal construction, it is easy to envision non-metal wire, mesh, plates and bonding materials used to fabricate NISHEX articles.

Examples and Testing

A subscale version of a NISHEX, consisting of a single, multi-layer fin element 21*a* was assembled and tested (NISHEX 1). The test article was constructed of five wire mesh layers, similar to what is shown in FIG. 5B. The wire meshes were constructed using progressively larger size copper wire and lower mesh number (or wire density) as listed in Table 2, below. These meshes covered wire sizes from 0.0045-inch to 0.012-inch diameter. The mesh layers were bonded to a copper bar, which represented the heat source.

TABLE 2

NISHEX1 Test Article Wire Mesh Characteristics

| Layer | Wire Size (inches) | Mesh (Wires per inch) |
|---|---|---|
| 1 | 0.0045 | 100 × 100 |
| 2 | 0.0055 | 80 × 80 |
| 3 | 0.0075 | 60 × 60 |
| 4 | 0.010 | 40 × 40 |
| 5 | 0.012 | 30 × 30 |

A broad range of wire mesh sizes and/or wire density may be used to construct a NISHEX. As such, the wire sizes and densities shown in Table 2 should not be viewed as limiting on the embodiments for a NISHEX. Moreover, in other embodiments a NISHEX may use more than five layers (e.g. eight layers may be used) or less than five layers.

The five layers of mesh wire channels that formed the NISHEX test article (NISHEX1) was formed using dies. These dies created different mesh fin shapes and heights, depending on wire diameter, similar to what is shown in FIG. 5A. Only a single "fin" was created. However, single fin performance results can be easily extrapolated to the multiple fin case, e.g., FIG. 5A. The separate fins of different wire mesh were bonded to a copper bar. To bond the five mesh layers forming the fin to the copper bar, an electrically heated furnace with an inert gas was used with a high conductivity braze material.

The test article was constructed using wire mesh weave with all wires oriented at 45° to the flow direction, as compared to perpendicular/parallel to the mean flow direction. This orientation of the heat conducting mesh wires may not be optimal. NISHEX 20, which may be more optimal, has wires arranged perpendicular and parallel, respectively, to the mean flow direction. The wires arranged parallel to the mean flow direction have a smaller diameter and/or are fewer in number than the diameters that are arranged perpendicular to the mean flow direction. However, for convenience, an isotropic wire mesh was used in a multiple layer non-isotropic configuration with the wires aligned at 45 degrees to the flow direction to ensure that each wire had contact with the base plate 15 in FIG. 5*a*. While non-optimal, the 45 degrees and any non-perpendicular 90 degrees wire orientation provides some direct contact of all wires with the bonding plate thereby facilitating a direct conduction path through each wire. However, the wire length, L, through which the heat must pass from a given perpendicular distance from the separation plate is increased, which then increases mL, as defined earlier. This then reduces fin effectiveness, as given in FIG. 1. This can be compensated to some extent by increasing the wire diameter d, since mL is a function of L/d.

During the bonding operation for NISHEX1, the furnace was operated at 670 C, to ensure a good bond. Once cooled down, the mesh material at the sides of the bar were trimmed to a total width of 0.5-inches for the test. To simulate the electronics heat load, a 0.125-inch diameter cartridge heater was inserted in the center of the copper bar, or heat sink plate simulator.

Given the small heat input, the test article needed to be heavily insulated to prevent heat loss from impacting the test results. A 3-inch diameter Microtherm insulation, plus low-density, fiber insulating blanket, was used to minimize heat loss effects. Airflow into the single fin test article was monitored and controlled, as well as the heater input.

Figure 7:
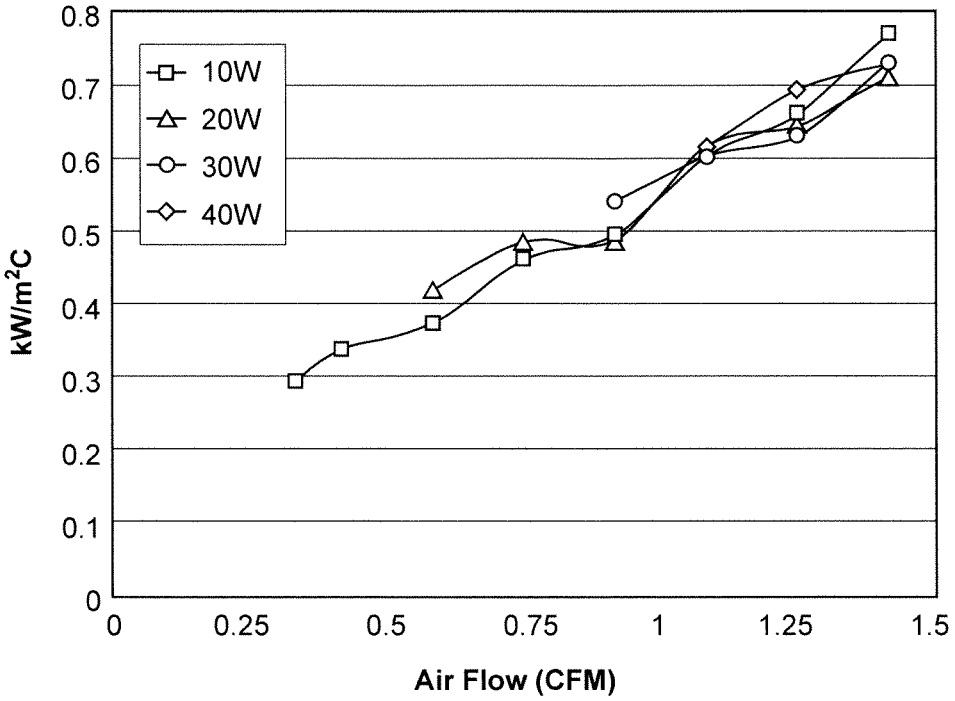
FIG. 7 shows heat transfer versus air flow through a test article constructed in accordance with the disclosure.

To determine heat transfer performance, the inlet air, bar and outlet air temperatures were measured. Also, the pressure drop across the heat exchanger was measured. During testing, single fin heater inputs of 10 to 40 Watts and airflows from 0.33 to 1.42 CFM were tested. FIG. 7 plots the heat transfer per source area and per degree temperature rise as a function of airflow for the test article.

The results shown in FIG. 7 are for a 0.28 inch flow height NISHEX1. As shown, the heat transfer increases with airflow. Higher heat transfer rates could be achieved by increasing airflow beyond the values tested. These single fin results can be readily extrapolated to multiple fin cases, of four inches length, where heat dissipated and flow are simply equal to the base test results multiplied by the number of fins.

Figure 8:
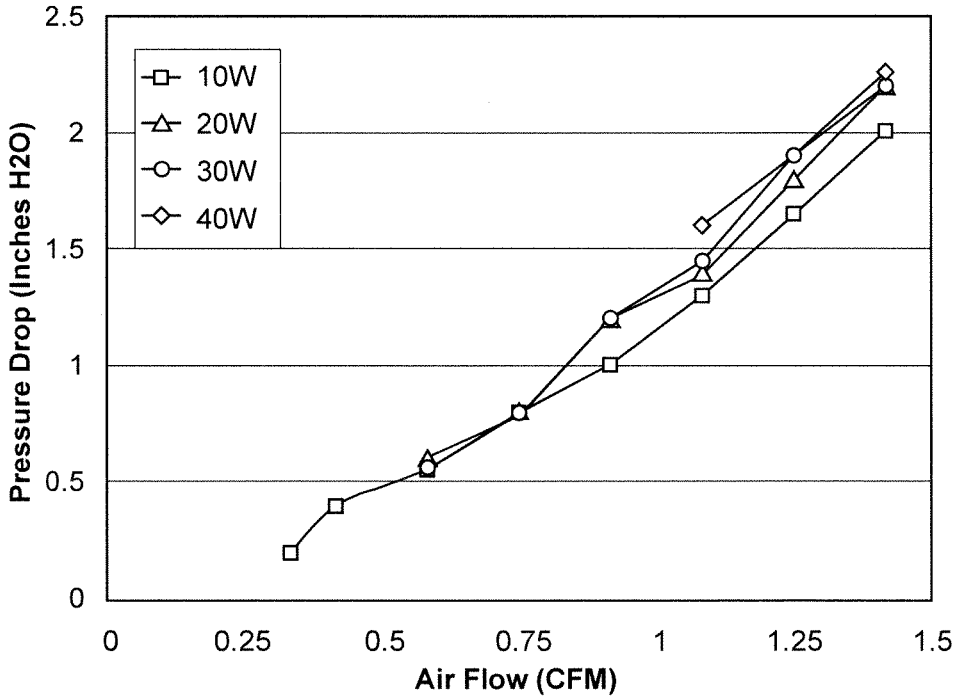
FIG. 8 shows a pressure drop versus air flow for the test article of FIG. 6.
Figure 9:
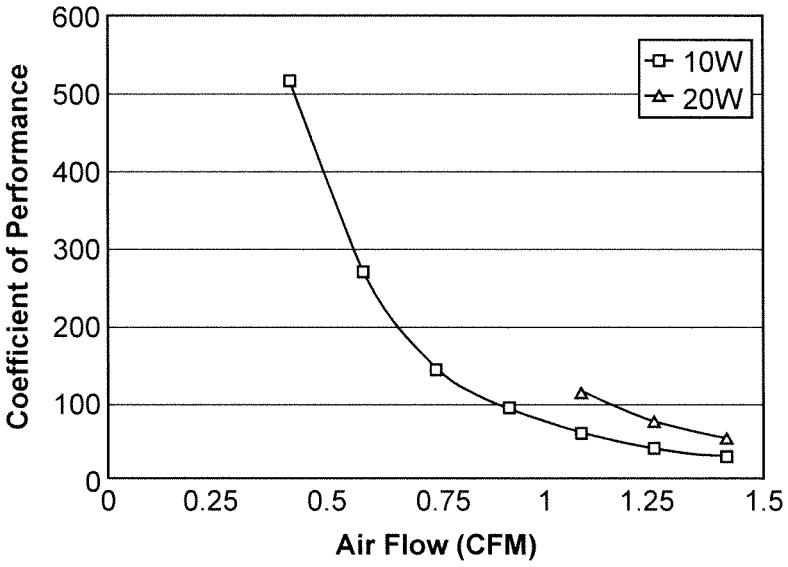
FIG. 9 shows a coefficient of performance versus airflow for the test article of FIG. 6.

Pressure drop performance was also very good for the test article, as shown in FIG. 8, where pressure drop ranges from 0.2 to 2.25 inches, depending on the specified airflow and heat dissipated. Taking the heat transferred and dividing by the power required to drive the flow (i.e. pressure drop times flow) a Coefficient of Performance (COP) can be determined. As shown in FIG. 9, for the cases where the heat source temperature is below 85 C, the COP is between 515 and 30. This is a high ratio, and indicates a high thermal efficiency for NISHEX1.

Figure 10:
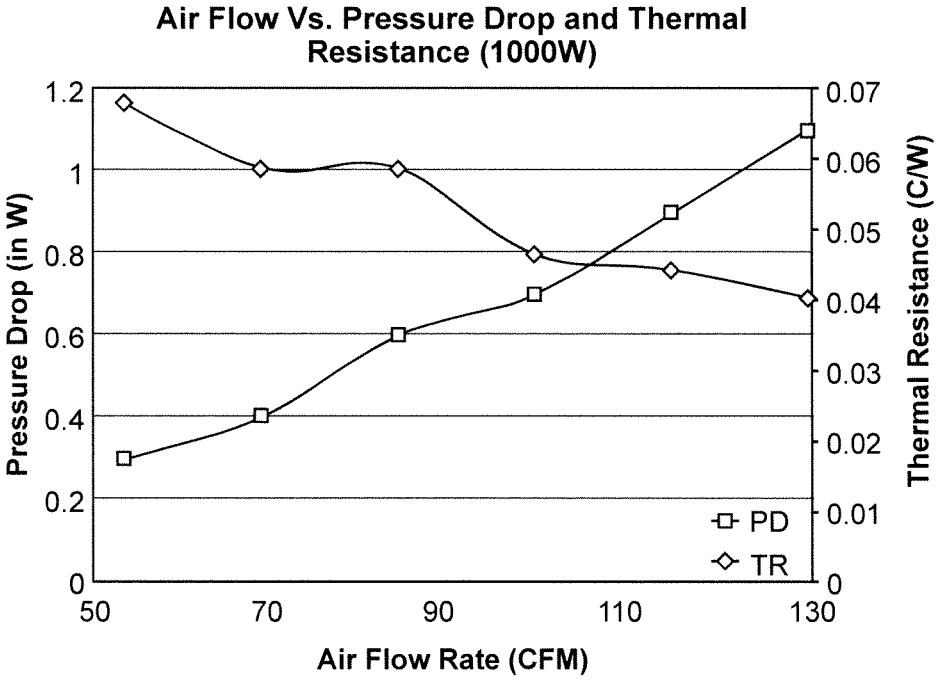
FIG. 10 shows the pressure drop and thermal resistance versus air flow for a full-scale heat exchanger based on test results for the test article of FIG. 6.

As another example of NISHEX1 capability, DARPA has recently identified a State-of-the-Art (SOA) and Microtechnologies for Air Cooled Exchangers (MACE) performance targets for a typical DOD 1000 W heat dissipation 4 inch×4 inch×1 inch high air cooled heat exchanger application. Using the single fin results in FIG. 7 and FIG. 8 (test article), and considering a split flow manifold with 2-inch long flow paths, the heat transfer and pressure drop for this typical application was estimated. These thermal resistance and pressure drop results are given in FIG. 10, for the 1000-Watt case. When the airflow is increased, the thermal resistance is decreased, which is a measure of the rise in temperature of the electronic component producing 1000 W in a real system. While a lower thermal resistance is desired, pressure drop increases. Nevertheless, the thermal and pressure drop performance of a NISHEX1-type construction for a HEX is outstanding. Results at airflow of 90 CFM, from FIG. 10, are compared to the DARPA SOA and MACE program targets in Table 3. While the pressure drop is near the baseline SOA level, for a factor of four higher heat transfer rate, the flow required is less than half the level required by a SOA heat exchanger. Therefore, the fan power requirement would be reduced from 100 W to 42 watts for a conventional fan. However, if an available improved Rotron fan were utilized, then the power would be reduced to 33 W for the same flow rate. This result is consistent with the MACE target. These results, given in Table 3, show that a NISHEX1-type construction for a NISHEX can easily exceed the SOA heat exchanger target and readily meet the MACE aggressive performance target. For NISHEX 20 (FIG. 5A) even better results are expected.

TABLE 3

Comparison of SOA, MACE Target and NISHEX1 Air Cooled Heat Exchanger Performance Results

| Parameter | SOA | MACE Target | NISHEX |
|---|---|---|---|
| Heat Source Power | 1 kW | 1 kW | 1 kW |
| Inlet Air Temp | 30 C. | 30 C. | 30 C. |
| Inlet Air Flow | 200 CFM | — | 90 CFM |
| Pressure Drop | 0.6 in H2O | — | |
| Blower Power | 100 W | 33 W | 33 W |
| System COP | 10 | 30 | 30 |
| Thermal Resistance | 0.2 C./W | 0.05 C./W | 0.05 C./W |
| Lateral Dimensions | 4 in × 4 in | 4 in × 4 in | 4 in × 4 in |
| Thickness | 1 in | 1 in | 1 in |
| Heat Sink Mass | 300 g | 300 g | 120 g |
| Blower Mass | 500 g | 500 g | 500 g |

The good performance of NISHEX1 versus DARPA SOA and MACE targets further supports that a NISHEX can also be effective in many applications. Importantly, a NISHEX is very compact, with the height of heat exchanger and manifold being less than one inch. The NISHEX concept uses 2-inch length segments that would be 0.28-inches high, fed by a manifold that is similarly 0.28-inches high that distributes air to the various segments. The air is then exhausted upward through slots in the structure. The 2-inch segments are probably not optimal. Nevertheless, the result of 4 to 8 kW potential heat dissipation, summarized above, shows that a NISHEX could readily extract the needed heat, yielding a low resistivity and pressure drop, in a very compact package.

A less compact and lower pressure drop (0.988-inches height) NISHEX test article was constructed of aluminum wire mesh (NISHEX2). The wire characteristics of the three layers are given in Table 4. As with the copper wire mesh case (NISHEX1), these meshes were readily available, but may not be optimal. Custom wire mesh, such as that shown in FIG. 3, could be utilized to optimize performance. However, for convenience, simple isotropic wire mesh oriented 45 degrees to the direction of flow was utilized for testing. Because of the higher conductivity of copper used in the more compact NISHEX1 copper test article, the fin will have a higher fin effectiveness. However, with aluminum or copper, wire conductivity is high and fin effectiveness will be high.

TABLE 4

Compact Aluminum NISHEX2 Test Article Characteristics

| Layer | Wire dia (in.) | Fin height (in) | Fin Density | Wire Mesh Density | Fin Surface area/layer, $A_f$(in$^2$) | Fin Effect | Fin area (ft$^2$) |
|---|---|---|---|---|---|---|---|
| Top | 0.02 | 0.988 | 5 | 14 | 512 | 0.842 | 2.993 |
| Mid | 0.016 | 0.745 | 5 | 20 | 465 | 0.881 | 2.844 |
| Bottom | 0.014 | 0.50 | 5 | 24 | 362 | 0.934 | 2.347 |
| | | | | | | | 8.184 |

For the copy test article, the NISHEX1 was operated as a heat sink, where the high temperature plate dissipates heat to the cooler air through the fin. This is directly applicable to radiator and heat sink problems. By using the data to define a heat transfer coefficient, the test results can be readily adapted to radiator cooling, or any other heat management solution. Therefore, the heat sink heat transfer coefficient results are directly applicable to the radiator cooling problem.

Performance of the single fin, illustrated in FIG. 7, can be extrapolated to multiple fins by using a number of 4"×0.25" fins to cover the base area of interest. In addition, the increased base area result is then multiplied by the temperature difference to yield the total heat transfer. However, by directly comparing volumetric heat transfer coefficients between different fin configurations at the same face velocity, volumetric advantages of the different configurations can be readily determined.

For the less dense NISHEX2 test article, two adjacent fins were created. In this test case, hot air flowed either parallel or perpendicular to the mesh fins that were encased in a rectangular channel that guided the flow. As with the single fin NISHEX1 copper test article, the edges where the mesh is bonded to the plate were trimmed prior to testing. The fin attachment plate was cooled by a flow of water. Therefore, NISHEX2 tests had heat flow opposite to the copper NISHEX1 tests. However, as per standard compact heat exchanger design approaches, if heat transfer results are reduced to heat transfer coefficients, these are applicable to different temperature and heat flow direction conditions.

Figure 11:
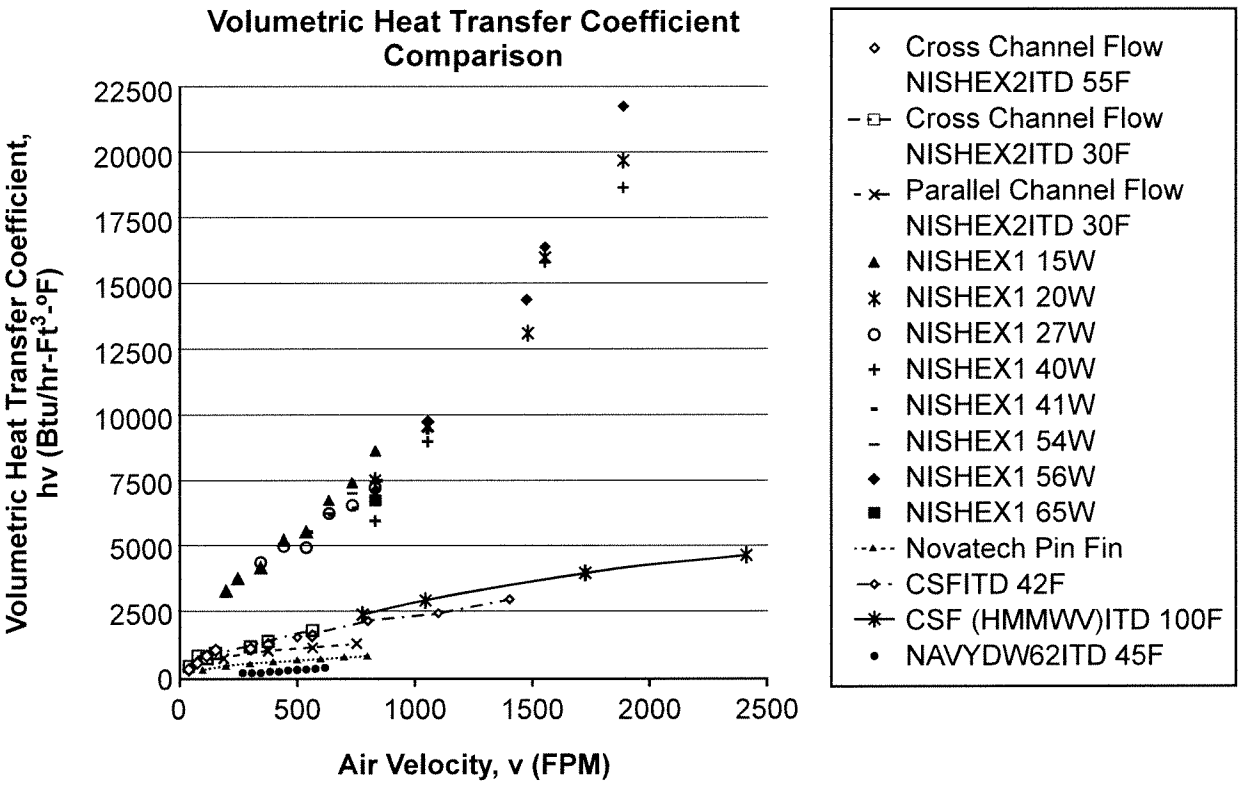
FIG. 11 compares a copper NISHEX test article and aluminum NISHEX test article to conventional HEX results over a range of air face velocities of interest.

FIG. 11 compares the copper NISHEX (NISHEX1) and aluminum NISHEX (NISHEX2) to conventional HEX results over a range of face velocities of interest. Because of the different sizes and operating conditions, a volumetric based heat transfer coefficient is created for each HEX. This is equal to the heat transfer divided by the volume of the HEX and the temperature difference between the initial air condition and metal surface bounded by the liquid coolant or heat source.

As noted above, by reducing heat transfer results to heat transfer coefficients, different compact HEX approaches can be directly compared. The conventional Navy DW62 cooling coil results given in FIG. 11 used copper cylindrical coolant tubes and wavy plate fins. This is a well proven and currently deployed radiator design that has been used in Navy ships, although most ships use an earlier and lower performance version. The heat sink included for comparison in FIG. 11 was aluminum with pin fins. This configuration is typically used for electronics cooling applications, where the heat sink is directly bonded to the electronics component. Since NISHEX1 and NISHEX2 can also be used for this purpose, the pin fin heat sink represents a good basis for comparison.

As shown in FIG. 11, all of the heat transfer coefficients increase with velocity, or Reynolds number. The Navy cooling coil has the lowest heat transfer coefficient and thereby requires the largest volume to meet a specific thermal management heat transfer requirement. The pin fin heat sink has a higher heat transfer coefficient than the Navy cooling coil case, and will result in a lower volume. Comparing results, the pin fin heat sink has an 87% higher heat transfer coefficient at 750 fpm face velocity. As shown, the low power compact NISHEX2 heat transfer coefficient results are superior to conventional Navy cooling coil and heat sink HEXs, as can be seen in FIG. 11. The compact NISHEX2 heat transfer coefficients are between 60% and 400% higher than the conventional HEX results at 750 fpm face velocity. This supports that the NISHEX2 designs would only require 63% to 20% of the volume needed for conventional HEXs to transfer the same heat. This is a very substantial reduction. Most importantly, the very compact NISHEX1 design gives a heat transfer coefficient that is between 767% and 1525% higher than the conventional HEXs. This supports that the NISHEX1 will require only between 11.5% and 6.6% volume to achieve the same heat transfer as the conventional HEXs. These are extraordinary volume reductions for NISHEX1 versus conventional HEXs, and support the use of this approach for cooling applications of interest. It should be noted that the very compact NISHEX1 has over 2.5 times the mesh surface area per volume as the compact NISHEX2. This is an important reason for the better performance of the NISHEX1. The clear volume and weight advantages of NISHEX1 are shown in Table 5.

TABLE 5

Comparison of Conventional and NISHEX1 Based Radiators

| Parameter | NISHEX1 | Cooling Coil | Pin Fin |
|---|---|---|---|
| Heat Transfer (kW) | 55.7 | 55.7 | 55.7 |
| Temperature Air (C.) | 40 | 40 | 40 |
| Temperature Water (C.) | 60 | 60 | 60 |
| Volume (cf) | 0.61 | 9.92 | 6.61 |
| Height (inches) | 27 | 27 | 27 |
| Width (inches) | 27 | 27 | 27 |
| Depth (inches) | 1.5 | 23.4 | 15.6 |
| Weight (lbs) | 35 | 195.3 | 210.8 |

In addition to lower volume and weight, NISHEX1 based radiators will have a reasonable pressure drop. At face velocity of 1000 fpm and equal heat transfer, results in Table 6 show that the NISHEX1 pressure drop is low, and comparable to the pin fin case that has a much higher volume. Importantly, the fan power requirement for NISHEX1 is only 1.4 kWe.

TABLE 6

Comparison of Scaled Pressure Drop for the Same Heat Transfer

| HEX Type | Pressure Drop at 1000 fpm (inches $H_2O$) | Estimated Fan Power (kWe) |
|---|---|---|
| Navy cooling coils | 2.55 | 3.76 |
| Pin fin heat sink | 0.86 | 1.27 |
| NISHEX1 | 0.96 | 1.42 |

Using results in Table 5, NISHEX1 volume and weight advantages versus conventional radiators can be determined. These results are highlighted in Table 7. As shown, the NISHEX1 radiator core is over 90% and over 80% lower in volume and weight relative to alternative conventional radiators.

TABLE 7

NISHEX1 Radiator Advantages

| CATEGORY | NISHEX | | REDUCTION PERCENT |
|---|---|---|---|
| | | RADIATORS COOLING COIL | |
| VOLUME | 0.61 | 9.92 | 93.85% |
| WEIGHT | 35 | 195.3 | 82.08% |
| PRESSURE DROP | 0.96 | 2.55 | 62.35% |
| | | RADIATORS PIN FIN RADIATOR | |
| VOLUME | 0.61 | 6.61 | 90.77% |
| WEIGHT | 35 | 210.8 | 83.40% |
| PRESSURE DROP | 0.96 | 0.86 | −11.63% |

Method of Making Heat Exchangers

Figure 12:
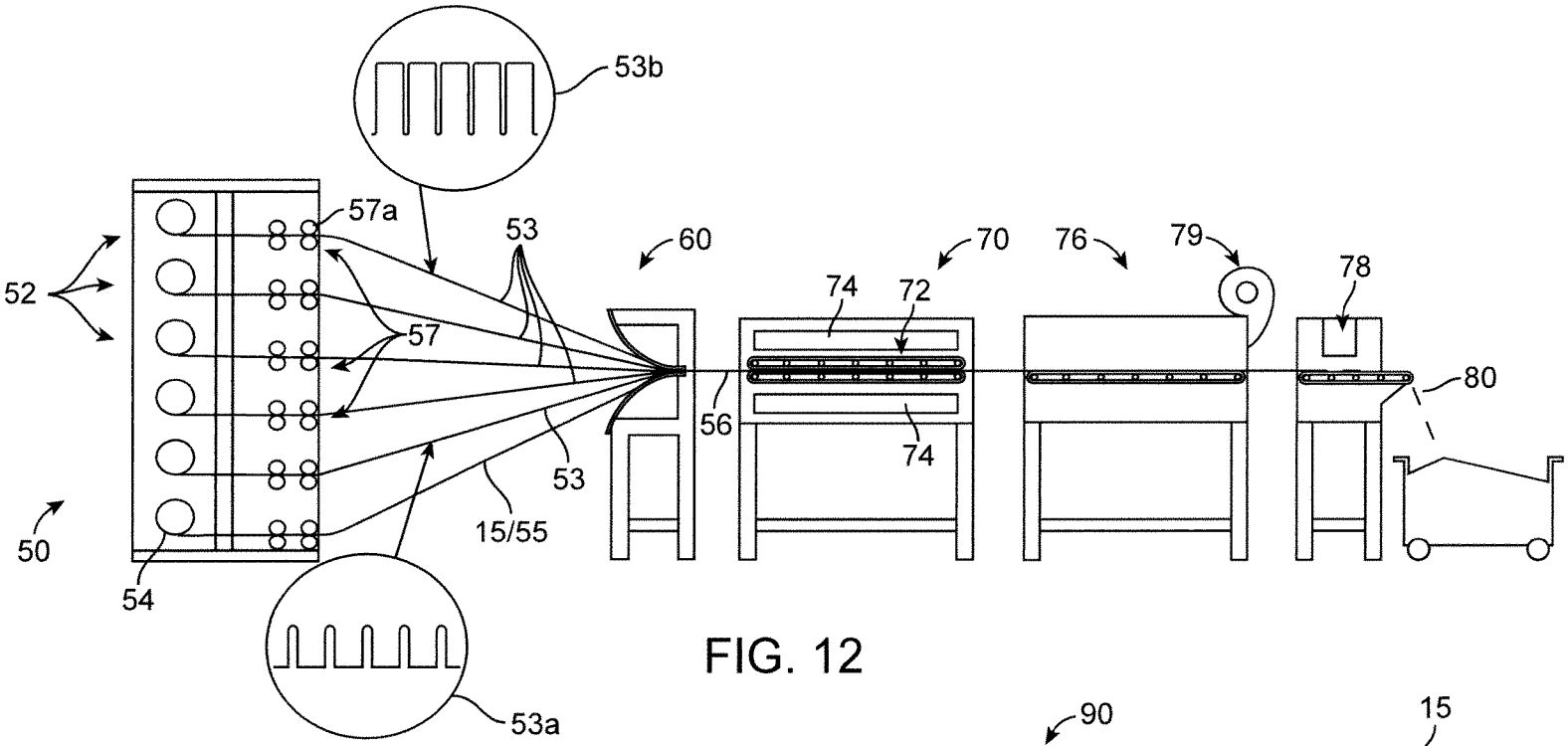
FIG. 12 is a side view of a NISHEX based heat sink forming machine.

A conceptual side view of a NISHEX assembly apparatus is depicted in FIG. 12. A NISHEX constructed using this apparatus includes nested, interleaved or stacked structures that are bonded to a bounding surface, which could be flatted tubes or a flat plate channel with liquid coolant, or a heat spreader flat plate with electronic, or other, components bonded. The multiple layers forming fin elements are constructed of either wire mesh of different characteristics, or even sheet with perforations or slits to restart the boundary layer.

The assembly apparatus allows for the production of NISHEX structures on a continuous basis using dispensing rolls of material. The assembly of the NISHEX proceeds from left to right in FIG. 12. A rack 50 holds rolls of mesh/sheet material 52 and rollers 57, for corrugating and dispensing material, that are fed towards an integration guide 60 downstream of the rack 50. Illustrated are five upper rolls 52 that hold the wire or sheet material that will be used to form the five layers of the fin elements 21*a*. The lower roll 54 holds the material used to form the sheet that may serve as a surface for a separation plate, a surface of a channel for coolant, or a heat spreader plate for example. The rollers 57 aligned with upper rolls 52, e.g., roller 57*a* which may be a "cog" wheel, or linear actuated die form corrugations in the wire or sheet material 53 as it is dispensed from the upper rolls 52. These different cogs or linear dies would be able to form the different shapes that correspond to the different layers. Examples of the corrugated shape are illustrated in 53*a* and 53*b* and FIGS. 5A-5B. The roller aligned with roll 54 guides the material towards the integration guide 60, which brings together the five layers forming the NISHEX and lower surface of the plate 15.

Referring to the case of a NISHEX formed form wire mesh, the mesh layer wire diameters would be smallest for the lowest rollers, and increase at higher rolls, with the top most using the thickest wire. This produces the various fin shapes in FIGS. 5A-5B. The roller aligned with the lowermost roller holding the sheet material 54 may be used to flatten out the supporting bottom sheet 55. Supply rolls 52 could alternatively hold solid sheet (of different thickness) that is then perforated or slit by the forming rolls, as well as formed into the "corrugated" shapes as illustrated by 53*a* and 53*b*.

After passing through the integration guide 60 the nested structure 56 then passes through a bonding device 70 having heaters, where the structure is trapped between metal belts on rollers 72. This keeps the layers pressed together as they are heated. There are heating elements 74 above and below a belt guide 72 that guides the nested structure 56 through the heater 70.

For some materials, the flat sheet 55 will have a coating of braze or solder compound that will melt and flow into the area where the layers come together. In other cases, the bonding compound will be added as a foil or paste at the bonding location where the plate and mesh are put in contact. Metal or non-metall bonding materials can be considered, depending on the application. In addition, a fixture could be used to hold the sheet 55 and corrugated mesh/sheet 53 layers together at the bond location in bonding area 70 as the assembly moves through the heaters 74. The heat will activate the bonding agent that will hold the assembly together. The nested layers then are pulled through a cooler area 76, where the bonding agent is cooled, e.g., using a cool air or gas blower 79, resulting in the construction of a strip of NISHEX with a supporting plate or sheet. The strip of NISHEX constructs exiting the cooling area 76 is then cut by a cutter 78 into the desired NISHEX 80 by a laser, or similar type cutter.

The machine shown in FIG. 12 is appropriate for the continuous manufacture of heat sinks. Depending on the materials of construction, inert gas or even vacuum would be required. In the vacuum and inert gas case, the entire continuous operation would have to be enclosed in a chamber. For more challenging materials, requiring higher temperatures and more processing time, the continuous process could be broken down into separate (1) nest formation and clamping, (2) furnace heat-up, soak and cool-down and, (3) cut to final length steps. For some applications, a high-conductivity non-metallic or composite adhesive could be used to bond nested sheet or wire mesh material together. As an alternative material for NISHEX, non-isotropic type foam could be created by casting methods, using a low-cost mold material. This non-isotropic foam would have characteristics similar to the nested mesh core. The non-isotropic foam approach could be accomplished for some applications, at some increase in cost. The foam would be bonded to separation flattened tubes or plates using similar methods to those described above.

Wires used to form fins may be arranged in different fashions to achieve different varieties of anisotropic fin elements. For example, in the case of NISHEX 10 (FIG. 4) the wires 14 connecting wires 12 do not touch the plate 15. This construction may be accomplished by selecting a mesh with spaced wires 14 that are aligned within a cog or other shaping device so that the connecting wires 14 are present on the fin elements formed by wires 12 but not the portions of wires 12 extending between the fin elements.

In another example, wire meshes can be used that interleave as they are nested or integrated. The meshes can be arranged so that all wires corrugated to form fin elements directly connect to the plate. Meshes may be integrated so that smaller wire diameter meshes nest between the larger mesh wires. Using this approach, all wires would touch the plate, as shown in FIGS. 6B through 6D rather than stack up on the plate as illustrated in FIGS. 5A-5B and 6A. Thus, wires 22, 24, 26, 28 and 30 used in NISHEX 20 would be placed side by side along the mean flow direction so that each wire would touch the plate 15. In this case, braze or other bonding material on the bounding plate would directly bond all wires to the plate. This would achieve a good thermal contact of wires with the plate, as well as reduce the flow blockage through the structure. These are advantages, but implementation may require a custom wire weave approach.

NISHEX Applications

Given the foregoing benefits and flexibility of a NISHEX, several applications are possible.

Heat Sinks.

As noted in FIG. 12, heat sinks that remove heat from electronic components can be prepared on a continuous basis using the highlighted equipment. In addition, depending on the materials and bonding compounds, the fabrication process can use batch rather than continuous methods. Also, depending on natural convection or a fan driven flow, either open or tight wire mesh nests can be utilized. While air cooled heat sinks are obvious applications, liquid cooling could also be utilized, with containment of the coolant accomplished through proper manifolding. In addition, boiling or condensing heat transfer could be implemented through refrigerant type fluids or water. The high surface area of the nests would be advantageous for boiling or condensing. Wires with "whiskers" would act as nucleation sites for more extensive boiling.

Plate and Fin Heat Exchangers and Reactors.

Figure 13:
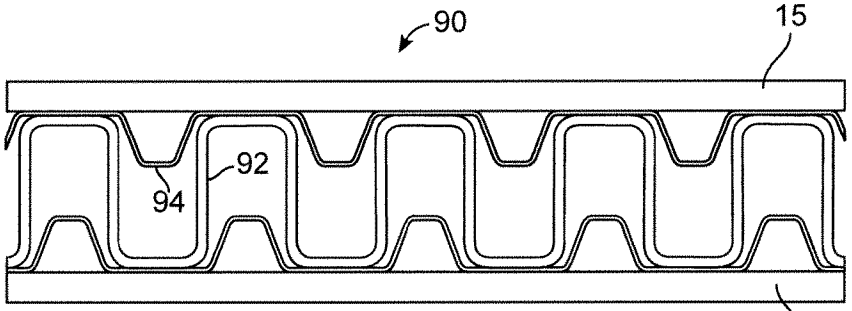
FIG. 13 is a side view of third embodiment of a NISHEX.

The nested structures produced using the apparatus of FIG. 12 can also be manufactured in the form of NISHEX 90 given in FIG. 13. In this case, the nesting of wires 92, 94 are symmetrical from the top and bottom. These structures can then be stacked in alternating directions to produce a cross-flow plate and fin heat exchanger. A minimum of two layers is required, with many layers common. Different materials, dimensions and number of layers can be considered, depending on the fluids and applications of interest. Manifolds can then be attached to these cores to form cross-flow, counter or co-flow heat exchangers.

Besides forming plate and fin-type heat exchangers using NISHEX, it is also possible to create reactors that promote simultaneous chemical reactions and heat transfer. This is accomplished by coating the NISHEX structure in one or both channels with appropriate washcoat and catalyst, using standard procedures. The high surface area NISHEX will promote both good reaction and heat transfer. This will be beneficial for reactions that are endothermic or exothermic and require simultaneous heat transfer during reaction.

Radiators and Cooling Coils.

Besides plate and fin heat exchangers, NISHEX structures can be used to create radiators, where the liquid coolant flows in flattened tubes, or thin channels, and NISHEX is used between the tubes or channels to transfer heat between the air and coolant. In addition to the simple radiator configuration, where a water/glycol-type mixture is used as a coolant, a structure using NISHEX could also be used as condensers and evaporators for refrigeration systems, where refrigerant is inside the tubes. Typically, the air side heat transfer limits condenser and evaporator performance. By using NISHEX to substantially enhance air side heat transfer, this limitation is overcome.

Integrating with Phase Change Materials.

Phase Change Materials (PCM), such as paraffinic waxes have a high heat of fusion that can be used to manage transient heat loads produced, for example, by pulsed electronics applications. As the unit is pulsed, a very high heat spike will propagate through the cooling system, leading to the over-temperature of the electronic components, unless the thermal management system is sized for the heat spike. However, by sizing the system for the peak, the weight, volume and cost for the system will be excessive versus a system sized for the average heat load. By including a PCM material in the loop, the PCM can absorb substantial energy as it converts from a solid to a liquid at nearly a fixed temperature. This will shave the peak temperature rise and allow an overall lower volume, weight and cost thermal management system.

While PCMs are very beneficial, those that are effective in the temperature range of interest are relatively poor conductors. In this case, a heat spike may not be absorbed in the time scale needed to prevent the over temperature of a component, due to the bottlenecking of heat transfer through the low conductivity PCM. To eliminate this bottleneck, NISHEX can be used, where one set of channels is filled with PCM and the other set contains the coolant flow. For this case the heat conduction path in the PCM is promoted by the presence of NISHEX in contact with the PCM. This greatly facilitates the thermal response of the PCM mass. By implementing NISHEX with PCM, both heat conductivity and heat capacity are balanced in PCM based thermal management systems. Lastly, while the beneficial case of a solid PCM is considered, NISHEX can also be used to optimize the impact of slurry type PCMs, where fluid heat capacity is enhanced by the addition of micro-encapsulated PCMs.

Other NISHEX Applications.

While the above applications highlighted the heat transfer benefits of NISHEX, this structure could also be used for other applications where a non-isotropic structure is beneficial. Isotropic foams are used as structural, filter and acoustic materials. In structural applications, the non-isotropic nature of NISHEX can be used to tailor crush progress when used to address impact or blast loads. These could be related to accidental impacts or as part of armor shields. For filtration, cross-flow could trap different size particles within the structure, depending on mesh size gradation. An axial flow, possibly combined with a pulsed back-flow, could then be used to periodically clean out the trapped particulate and renew the filtration effectiveness. Depending on the mesh material, layer number and nesting, the material could absorb acoustic waves and cause destructive interference and sound dispersion and damping to control noise. Also, NISHEX structures would also be able to dissipate vibrations. In summary, NISHEX could address all the applications that have utilized isotropic foam, with the added benefit that the NISHEX anisotropic characteristic can provide additional design flexibility to better address some applications.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various modifications are possible within the scope of the invention, as those skilled in the relevant art will recognize.

These modifications can be made to the invention in light of the above detailed description. The terms used in the claims should not be construed to limit the invention to the specific embodiments disclosed in the specification. Rather, the scope of the invention is to be determined entirely by the claims, which are to be construed in accordance with established doctrines of claim interpretation.

What is claimed is:

1. A heat exchanger construct, comprising:

a plate having a first side surface and a second side surface, opposite the first side surface;

a non-isotropic fin bonded to the first side surface and formed by first and second woven wire meshes, wherein the first wire mesh is corrugated, thereby forming a series of parallel ridges and grooves, including a plurality of first portions extending parallel to the first side surface, and a plurality of second portions forming first channels extending along a mean flow direction through the heat exchanger, wherein the second wire mesh is corrugated, thereby forming a series of parallel ridges and grooves, including a plurality of first portions extending parallel to the first side surface, and a plurality of second portions forming second channels extending along a mean flow direction through the heat exchanger, wherein a length and diameter of first wire mesh wires is greater than a length and diameter of second wire mesh wires, wherein the lengths are measured as maximum distances away from the first side surface, wherein the second channels nest within the first channels, and wherein the first portions of the first and second woven wire meshes are directly connected to each other and/or the first side surface; and further including a third corrugated wire mesh forming channels, wherein the third corrugated wire mesh channels are located between the first channels and the first side surface, and wherein the third corrugated wire mesh wires have a length and diameter less than the respective length and diameter of second corrugated wire mesh wires.

2. The heat exchanger construct of claim 1, wherein the fin effectiveness ($F_{eff}$) for the first wire mesh wires and second wire mesh wires is approximately equal to $$\tan h(mL)/mL$$

where L is the length of the first wire mesh wires and second wire mesh wires, respectively, $m=(4\ h/kd)^{1/2}$, h is the gas heat transfer coefficient, k is the thermal conductivity of the first woven wire mesh material and the second woven wire mesh material, respectively, and d is the diameter of the first wire mesh wires and second wire mesh wires, respectively.

* * * * *